US011330858B2

(12) United States Patent
Nimura

(10) Patent No.: US 11,330,858 B2
(45) Date of Patent: May 17, 2022

(54) HELMET

(71) Applicant: SHOEI CO., LTD., Tokyo (JP)

(72) Inventor: Taku Nimura, Tokyo (JP)

(73) Assignee: SHOEI CO., LTD, Tokyo (JP)

( * ) Notice: Subject to any disclaimer, the term of this patent is extended or adjusted under 35 U.S.C. 154(b) by 192 days.

(21) Appl. No.: 16/615,857

(22) PCT Filed: Mar. 23, 2018

(86) PCT No.: PCT/JP2018/011939
§ 371 (c)(1),
(2) Date: Nov. 22, 2019

(87) PCT Pub. No.: WO2018/216340
PCT Pub. Date: Nov. 29, 2018

(65) Prior Publication Data

US 2020/0146387 A1 May 14, 2020

(30) Foreign Application Priority Data

May 22, 2017 (JP) ..... JP2017-101150

(51) Int. Cl.
*A42B 3/20* (2006.01)

(52) U.S. Cl.
CPC ..... *A42B 3/205* (2013.01)

(58) Field of Classification Search
CPC ..... A42B 3/326; A42B 3/223; A42B 3/328
USPC ..... 2/421
See application file for complete search history.

(56) References Cited

U.S. PATENT DOCUMENTS

| | | | | |
|---|---|---|---|---|
| 4,042,974 | A * | 8/1977 | Morgan | A42B 3/326 2/9 |
| 4,907,300 | A * | 3/1990 | Dampney | A42B 3/228 2/424 |
| 5,396,661 | A * | 3/1995 | Sutter | A42B 3/223 2/6.4 |
| 7,555,788 | B2 * | 7/2009 | Schimpf | A42B 3/326 2/410 |
| 2013/0081199 | A1 * | 4/2013 | Nimura | A42B 3/326 2/421 |
| 2018/0103710 | A1 * | 4/2018 | Kim | A42B 3/326 |

FOREIGN PATENT DOCUMENTS

| | | | |
|---|---|---|---|
| JP | S6058768 | U | 4/1985 |
| JP | H0610941 | A | 1/1994 |
| JP | 2000-178822 | A | 6/2000 |
| JP | 2013-079459 | A | 5/2013 |

OTHER PUBLICATIONS

International Search Report dated May 2, 2018 for Appln. No. PCT/JP2018/011939; 4 Pages.

* cited by examiner

*Primary Examiner* — Timothy K Trieu
(74) *Attorney, Agent, or Firm* — Brooks Kushman P.C.

(57) ABSTRACT

Plural contact pieces of a shaft member, which is mounted to a helmet main body, abut a cam surface that is formed at a hole portion provided in a proximal end portion of a chin guard. When the chin guard is rotated from a fully closed position to a fully open position with respect to the helmet main body, at least one of the contact pieces abuts an anchor surface, and, simultaneously, at least another one contact piece fits into a concave portion, and, due thereto, the chin guard is fixed with respect to the helmet main body.

11 Claims, 14 Drawing Sheets

HELMET

CROSS-REFERENCE TO RELATED APPLICATIONS

This application is the U.S. national phase of PCT Application No. PCT/JP2018/011939 filed on Mar. 23, 2018, which claims priority to Japanese Patent Application No. 2017-101150 filed on May 22, 2017, which are incorporated herein by reference in their entireties.

TECHNICAL FIELD

The present disclosure relates to a helmet.

BACKGROUND ART

There has conventionally been proposed a full-face helmet having a chin guard that is supported so as to be rotatable with respect to a helmet main body, in whose front side an opening portion is formed, with shaft portions, which are formed at the left and right side portions of the helmet main body, being the rotational center. This has the advantage that the wearer does not have to take the helmet off at the time when the wearer smokes or eats and drinks.

For example, Japanese Patent Application Laid-Open (JP-A) No. 2013-79459 discloses preventing interference between a chin guard and a helmet main body at the time of rotation, due to a chin guard supporting mechanism rotating the chin guard while decentering the chin guard with respect to the helmet main body. Further, it is disclosed that there is provided a locking mechanism at which an engaging pin anchors on an anchor portion such that the chin guard does not fall-down toward the lower side unintentionally at the time when the chin guard is rotated toward the upper side and the opening portion of the helmet main body is opened.

SUMMARY OF INVENTION

Technical Problem

However, in a case in which the user rides a motor scooter or the like, there are cases in which the user rides with the full-face chin guard positioned at the upper portion of the helmet main body and the opening portion of the helmet main body opened. This is a method of utilization that exceeds the intent of the invention of Patent Document 1, and further improvement in the locking performance is required in order to reliably prevent falling-down of the chin guard at the time when the user is riding.

In view of the above-described circumstances, the present disclosure provides a helmet having an improved locking performance in a case in which the chin guard is fully open.

Solution to Problem

A helmet relating to a first aspect of the present disclosure comprises: supporting shafts that are fixed to outer side surfaces of a helmet main body, and that have outer peripheral surfaces at which a plurality of contact pieces are formed; and a chin guard having proximal end portions at which are formed supporting holes into which the supporting shafts are inserted, and that is mounted so as to be able to rotate around the supporting shafts that are inserted into the supporting holes, between a fully closed position at which the chin guard protects a jaw of a helmet wearer and a fully open position at which the chin guard expands a field of view of the helmet wearer, and at which cam surfaces, having positions of contact with the contact pieces that change accompanying rotation, are formed at inner peripheral surfaces of the supporting holes, wherein each cam surface has an anchor surface that, in a case in which the chin guard is rotated to a position immediately before the fully open position, by being abutted by at least one of the contact pieces accompanying rotation, imparts resistance in a direction opposite to a rotating direction of the chin guard, and a concave portion into which, in a case in which the chin guard is rotated past the immediately before the fully open position to the fully open position, at least one of the contact pieces is fit and that fixes the chin guard at the fully open position, and, when the chin guard rotates to the fully open position, the chin guard is fixed due to, with at least one of the contact pieces remaining in a state of abutting the anchor surface of the cam surface, another at least one of the contact pieces being fit in the concave portion.

In accordance with the helmet relating to the first aspect of the present disclosure, the supporting shafts that are fixed to an outer side surfaces of the helmet main body are inserted into the supporting holes that are provided in the proximal end portions of the chin guard, and the chin guard can rotate around the supporting shafts between the fully closed position and the fully open position. Plural contact pieces, at least one of which is, at the time of rotation of the chin guard, maintained in a state of abutting the cam surface that is formed at the inner peripheral surface of the supporting hole, are formed at the supporting shaft. Here, when the chin guard is rotated around the supporting shafts from the fully closed position toward the fully open position, at least one of the contact pieces moves relatively on the cam surface. Namely, the chin guard rotates at the front side of the helmet toward the fully open position.

Moreover, when the chin guard rotates around the supporting shafts toward the fully open position, due to at least one of the contact pieces abutting the anchor surface that is formed at the cam surface, resistance to the rotation is applied to the chin guard. As a result, the rotational speed of the chin guard is lowered or stopped. Due thereto, the helmet wearer recognizes that the chin guard has been rotated to just before the fully open position.

Subsequently, when the wearer rotates the chin guard to the fully open position, with at least one of the contact pieces remaining anchored on the anchor surface, at least one contact piece that is different than that contact piece fits into the concave portion, and the chin guard is fixed at the fully open position with respect to the helmet main body.

In this way, due to the chin guard being rotated from the fully closed position to the fully open position, at least one of the contact pieces that is formed at the supporting shaft fits together with the concave portion of the cam surface of the supporting hole that is formed in the proximal end portion of the chin guard, and, due thereto, the chin guard is reliably fixed with respect to the helmet main body. Namely, due to the contact piece being fit together with the concave portion, the locked state of the chin guard with respect to the helmet main body is secure.

In a helmet relating to a second aspect of the present disclosure, in the helmet relating to the above-described first aspect, each cam surface further has a decentering surface that, in a case in which the chin guard is rotated from the fully closed position to the fully open position, by being abutted by at least one of the contact pieces accompanying rotation, pushes the chin guard out in a forward direction.

In the helmet relating to the second aspect of the present disclosure, due to the decentering surface being provided at the cam surface, when the chin guard rotates around the supporting shafts from the fully closed position toward the fully open position, at least one of the contact pieces moves relatively on the decentering surface that is formed at the cam surface, and, due thereto, the chin guard is moved toward the helmet front side at the time of rotation. Namely, the chin guard rotates while being decentered toward the helmet front side. As a result, the shield and the chin guard interfering with the helmet main body at the time of rotation is prevented.

In a helmet relating to a third aspect of the present disclosure, in the helmet relating to the above-described first aspect or second aspect, each supporting shaft has a supporting plate that is mounted to the outer side surface of the helmet main body, and a shaft member that is mounted to the supporting plate with a proximal end portion of the chin guard between the shaft member and the supporting plate, and has an outer peripheral surface at which are formed the contact pieces that abut the cam surface that is formed at the supporting hole of the proximal end portion.

In accordance with the helmet relating to the third aspect of the present disclosure, the supporting plate is mounted to the outer side surface of the helmet main body, and the shaft member is mounted to the supporting plate with the proximal end portion of the chin guard being between the shaft member and the supporting plate. Due thereto, the contact pieces that are formed at the shaft member can be made to abut the cam surface that is formed at the supporting hole of the proximal end portion of the chin guard. Namely, assembly is easy.

In a helmet relating to a fourth aspect of the present disclosure, in the helmet relating to the above-described third aspect, a projecting portion that projects out toward a supporting plate side is formed at each proximal end portion, and a temporarily anchoring concave portion, on which the projecting portion is anchored when the chin guard arrives at the position immediately before the fully open position, is formed at a surface that is at a proximal end portion side of the supporting plate.

In accordance with the helmet relating to the fourth aspect of the present disclosure, the projecting portion, which is formed so as to project-out toward the supporting plate side, is provided at the proximal end portion of the chin guard. On the other hand, the temporarily anchoring concave portion, on which the projecting portion anchors at the time when the chin guard arrives at the position immediately before the fully open position, is provided at the supporting plate at the proximal end portion side surface of the supporting plate. Accordingly, there is a structure in which, at a position that is before the chin guard is rotated to the fully open position and at least one contact piece fits together with and is fixed to the concave portion, the chin guard can be locked without even applying as much force as when locking the chin guard at the fully open position, while the chin guard is prevented from falling-down toward the fully closed position side due to the projecting portion being anchored on the temporarily anchoring concave portion. Namely, handling in a case in which the chin guard is temporarily open is excellent.

In a helmet relating to a fifth aspect of the present disclosure, in the helmet relating to the above-described third aspect or fourth aspect, a projecting portion that projects out toward a supporting plate side is formed at each proximal end portion, and an actually anchoring concave portion, with which the projecting portion is fit together when the chin guard arrives at the fully open position, is formed at a surface that is at a proximal end portion side of the supporting plate.

In accordance with the helmet relating to the fifth aspect of the present disclosure, the projecting portion, which is formed so as to project-out toward the supporting plate side, is provided at the proximal end portion of the chin guard. On the other hand, the actually anchoring concave portion, with which the projecting portion is fit together at the time when the chin guard arrives at the fully open position, is provided at the proximal end portion side surface of the supporting plate. Accordingly, when the chin guard is moved from the fully closed position to the fully open position, the projecting portion of the supporting plate, which is mounted to the outer side surface of the helmet main body, is anchored on the actually anchoring concave portion that is formed at each proximal end portion side surface of the supporting position, and the rotational movement of the chin guard with respect to the helmet main body can be stopped. Namely, due to at least one of the contact pieces of the supporting shaft being fit together with the concave portion of the hole portion of the chin guard, and the projecting portion being fit into the actually anchoring concave portion, the chin guard is fixed at the fully open position with respect to the helmet main body. Namely, the locking performance of the chin guard is improved more.

DESCRIPTION OF EMBODIMENTS

A helmet relating to an embodiment of the present disclosure is described with reference to FIG. 1~FIG. 14. Note that the front-rear direction front side as seen from the wearer in the state in which he/she is using the helmet is denoted by arrow FR, and the right side and the left side are denoted by arrow RH and arrow LH, respectively, and the vertical direction upper side is denoted by arrow UP. Further, in the following description, when merely front-rear, left-right and vertical directions are indicated, they refer to the front-rear, the left-right and the vertical as seen from the wearer who is in a state of wearing the helmet.

Figure 1:
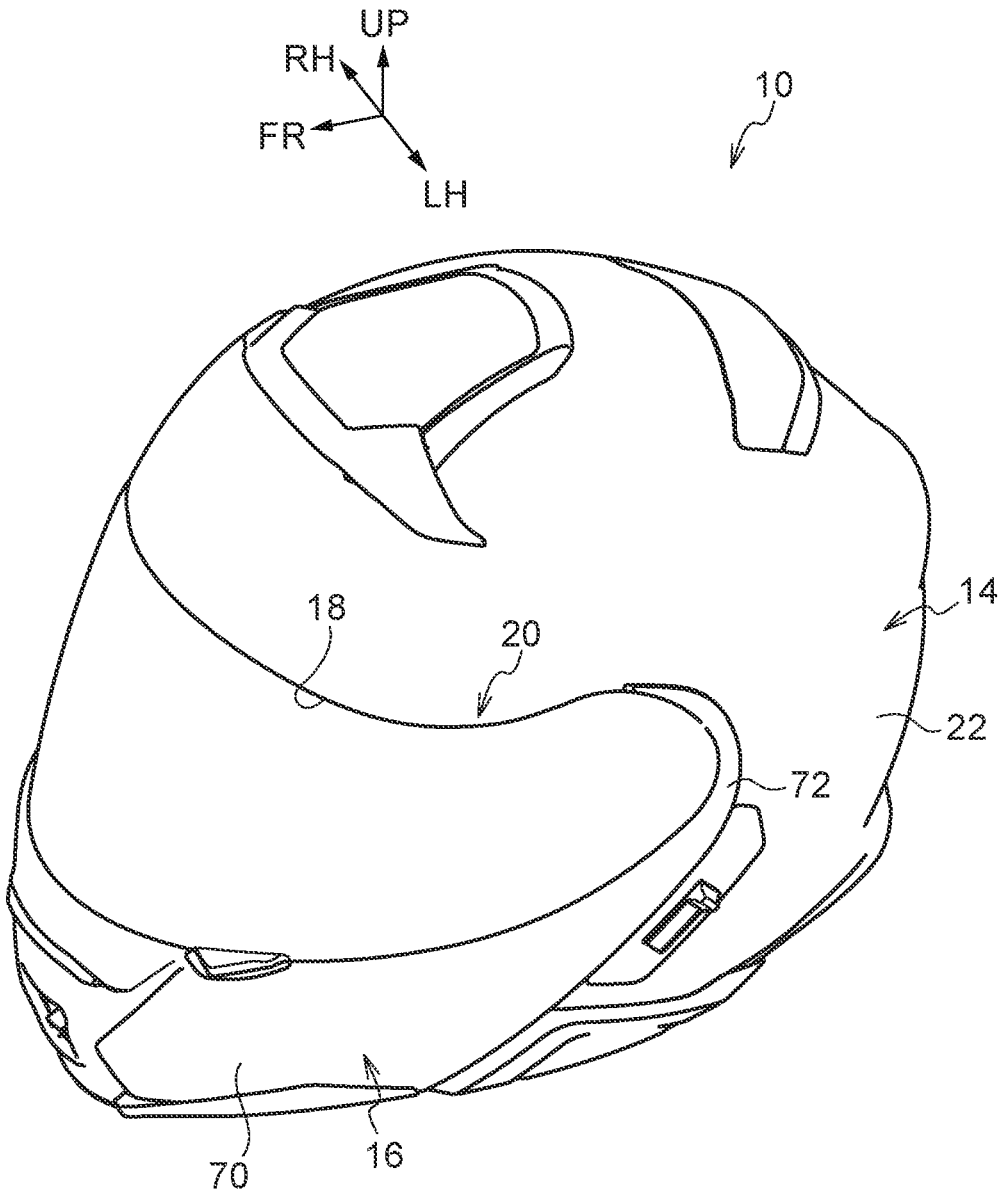
FIG. 1 is a perspective view showing a state in which a chin guard is fully closed, of a helmet relating to an embodiment.
Figure 2:
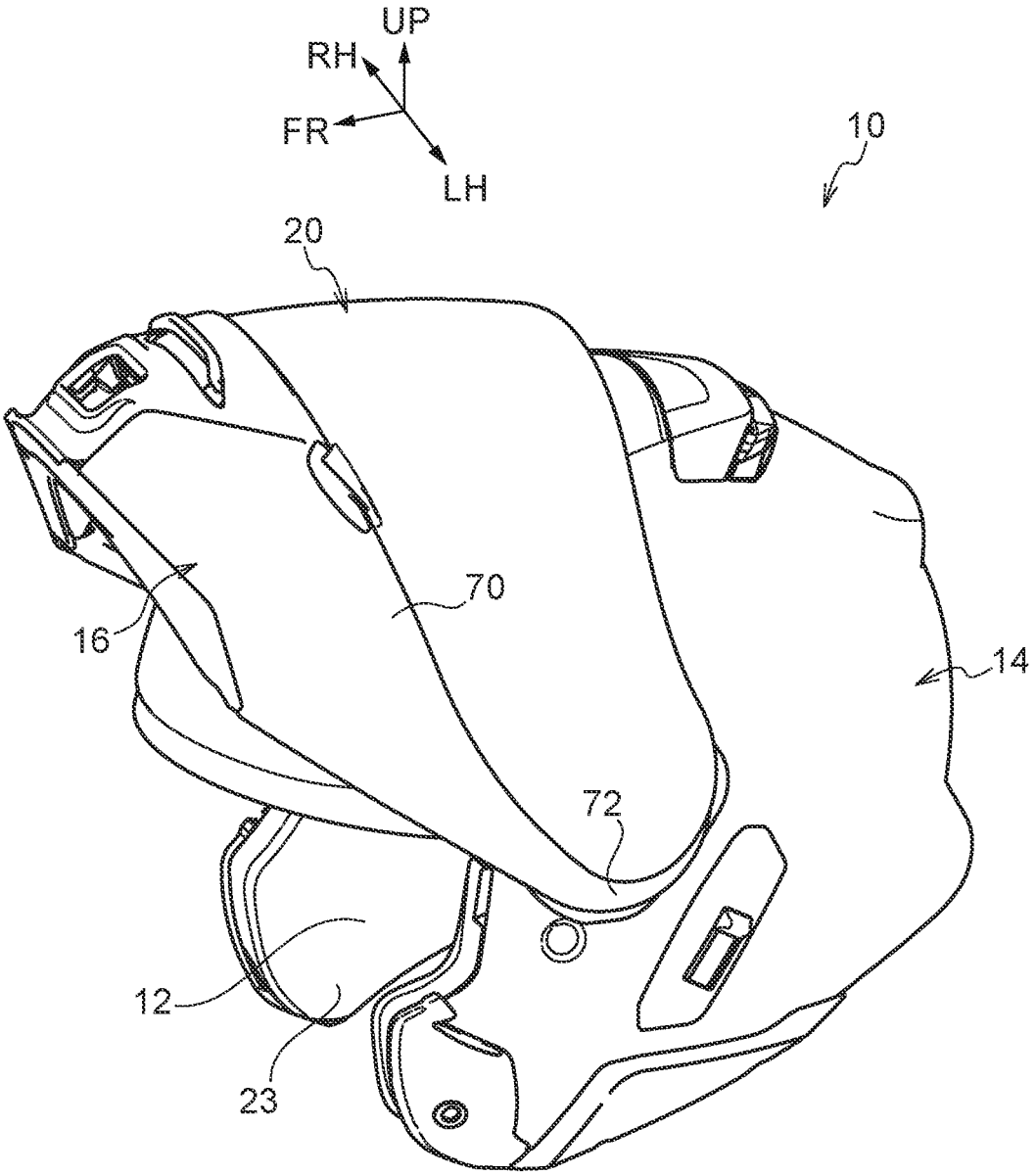
FIG. 2 is a perspective view showing a state in which the chin guard is fully open, of the helmet relating to the embodiment.

As shown in FIG. 1 and FIG. 2, a helmet 10 has a helmet main body 14 in which is formed an opening portion 12 that opens toward the front side, a chin guard 16 that is mounted to the helmet main body 14 so as to be able to rotate around shaft members 90 that are described later, and a shield 20 that closes a window portion 18 that is formed by the helmet main body 14 and the chin guard 16 that is in a fully closed state that is described later, and that is mounted so as to be able to rotate around the shaft members 90 with respect to the helmet main body 14.

A liner is attached to the inner side of an outer shell 22 of the helmet main body 14, and pads 23 and the like for improving the wearing comfort of the helmet wearer (hereinafter called "wearer") are mounted to the inner side of the liner.

Figure 3:
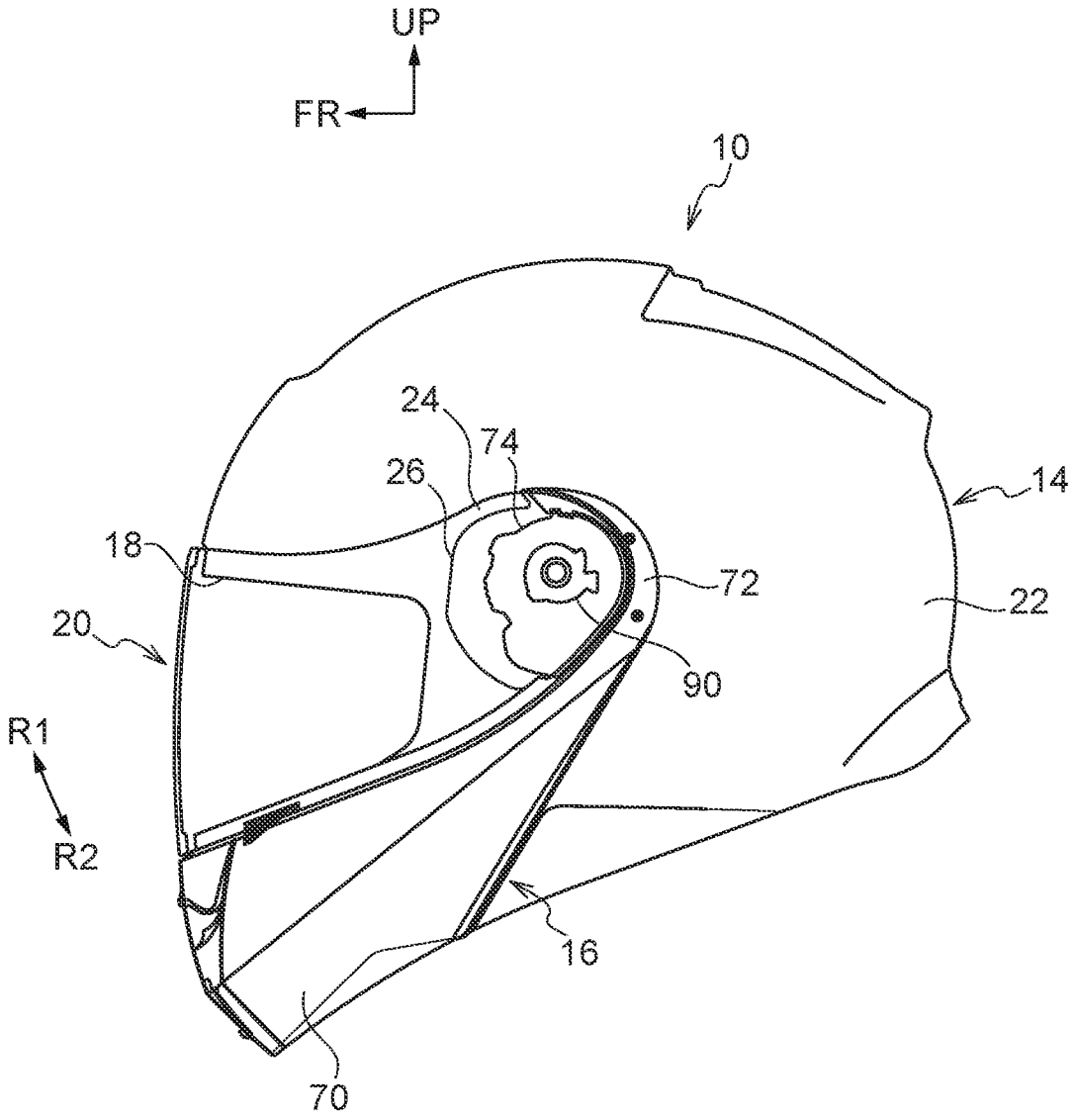
FIG. 3 is a partially omitted side view showing the state in which the chin guard is fully closed, of the helmet relating to the embodiment.

As shown in FIG. 3, a supporting plate 26 that structures a supporting shaft is mounted to each of mounting portions 24 that are at the left and right both side portions ofthe outer shell 22 of the helmet main body 14. Note that, because the structures of the mounting portions 24 have left-right symmetry and are similar, only the left side is described hereinafter, and description of the right side is omitted.

Figure 7:
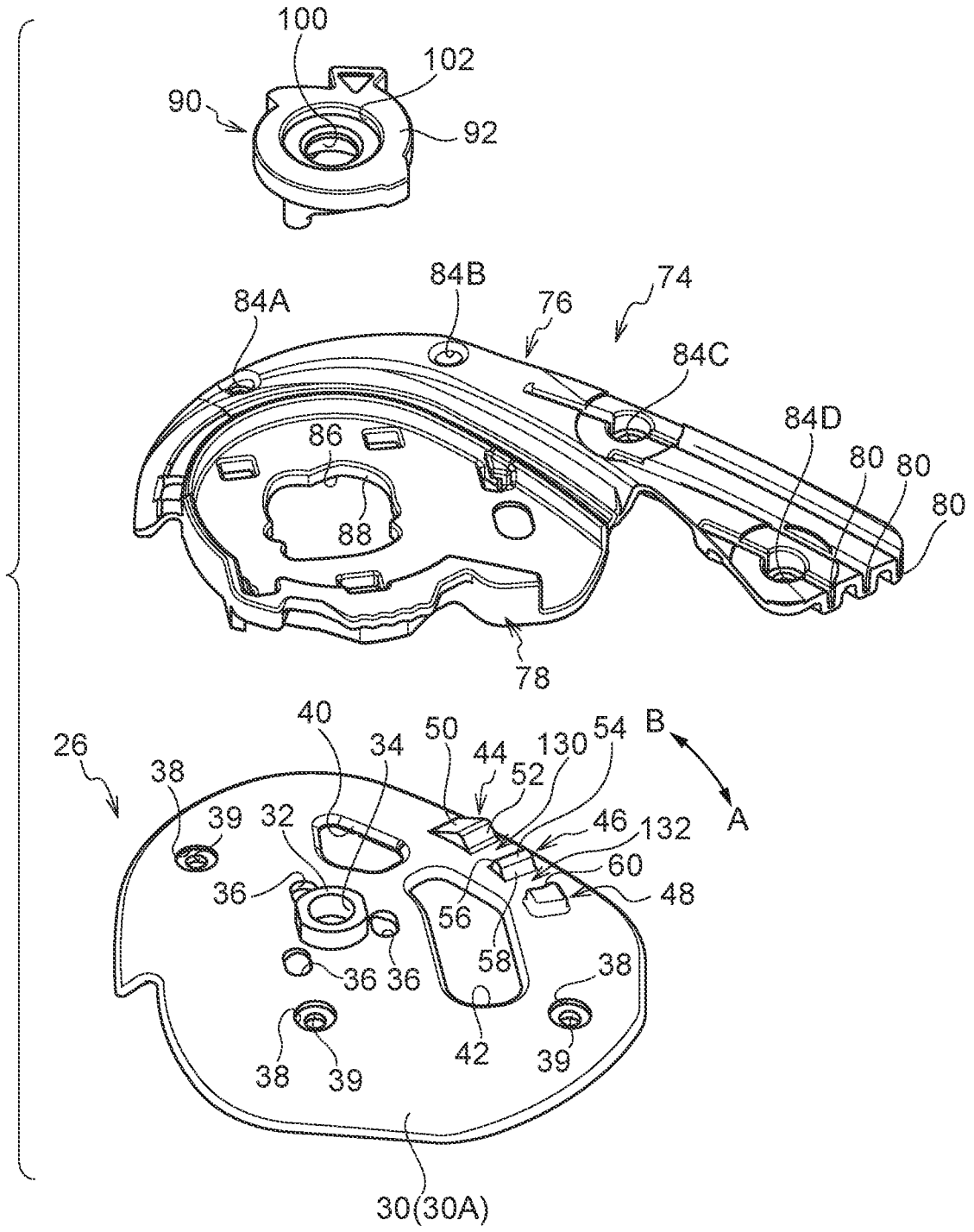
FIG. 7 is a partially omitted exploded perspective view that is seen from an obliquely outer side and shows a chin guard supporting structure relating to the embodiment.
Figure 8:
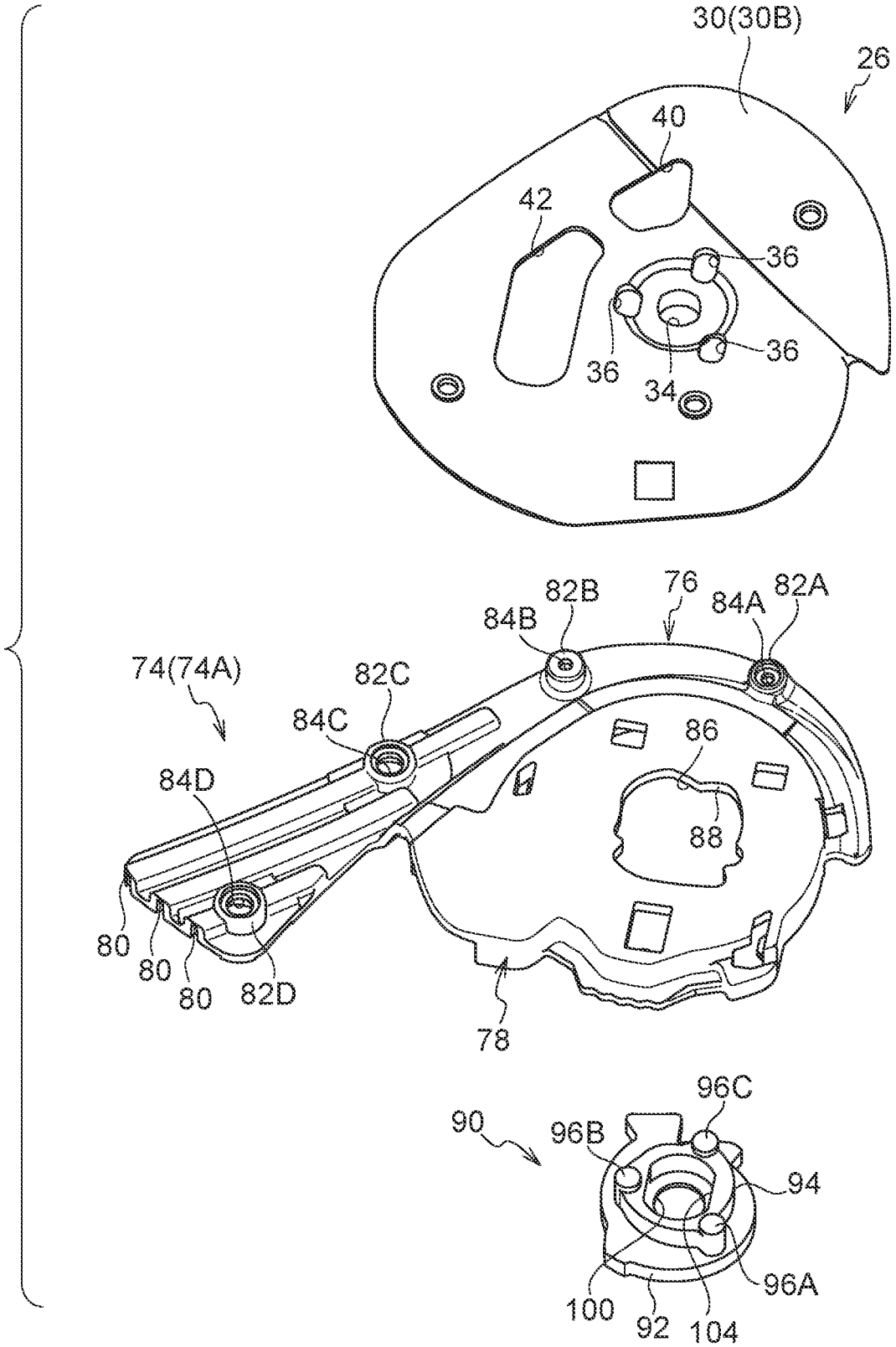
FIG. 8 is a partially omitted exploded perspective view that is seen from an obliquely inner side and shows the chin guard supporting structure relating to the embodiment.
Figure 9:
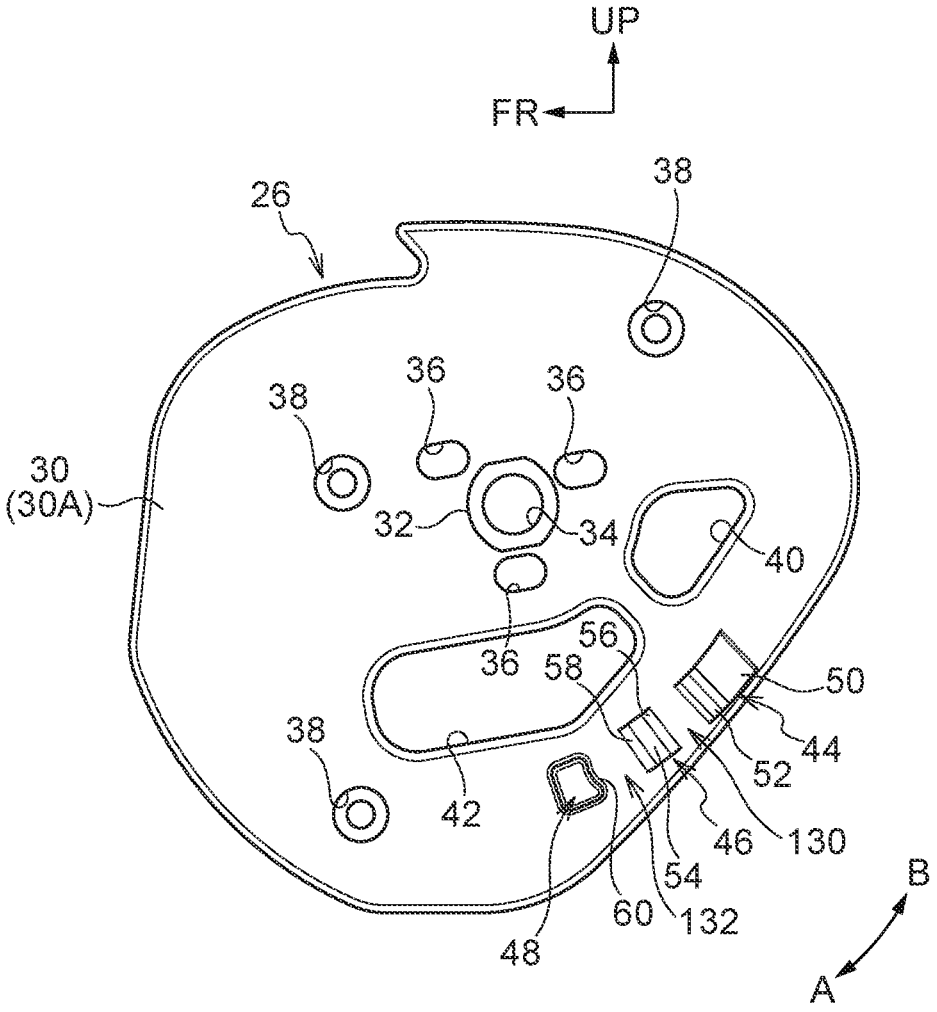
FIG. 9 is a side view that is seen from the outer side of a supporting plate relating to the embodiment.

As shown in FIG. 7 through FIG. 9, the supporting plate 26 is a plate body 30 that is substantially circular as seen in a side view, and a boss 32, which is elliptical as seen in a side view, is formed so as to project-out toward the outer (left) side at the substantial center of the plate body 30. Here, elliptical means a shape that is formed from a pair of parallel rectilinear portions and circular-arc portions that connect the end portions of the rectilinear portions. An insert-through hole 34, which is is circular and is for the insertion of a screw therethrough and that passes-through from the obverse side to the reverse side of the plate body 30, is formed in the central portion of the boss 32. As seen in a side view, three long holes 36, through which contact pieces 96A, 96B, 96C of the shaft member 90 that is described later are inserted respectively, are formed at the periphery of the boss 32 of the plate body 30.

Further, recesses 38 are formed at three places in the plate body 30 of the supporting plate 26, and screw insert-through holes 39 are formed in the bottom surfaces of the recesses 38. Accordingly, the supporting plate 26 is mounted to the mounting portion 24 of the helmet main body 14 (the outer shell 22) due to unillustrated screws being inserted into the screw insert-through holes 39 from the recess 38 sides.

Moreover, two hole portions 40, 42 are formed in the plate body 30, and lightening of the weight of the supporting plate 26 is devised.

Further, a first projecting portion 44, a second projecting portion 46 and a third projecting portion 48 (hereinafter called "first projecting portion 44 third projecting portion 48") are formed in an outer (left) side surface 30A of the plate body 30, in that order in the direction of arrow A around the insert-through hole 34 as seen in a side view. Note that, at the plate body 30, the portion that is sandwiched between the first projecting portion 44 and the second projecting; portion 46 corresponds to the temporarily anchoring concave portion 130, and the portion that is sandwiched between the second projecting portion 46 and the third projecting portion. 48 corresponds to the actually anchoring concave portion 132.

At the first projecting portion 44, the arrow B side around the axis is a gently inclined surface 50 that is inclined toward the outer side while heading toward the arrow A side, and the arrow A side around the axis is an inclined surface 52 that is inclined toward the outer side while heading toward the arrow B side. Note that the angle of inclination of the inclined surface 52 with respect to the plate body 30 is greater than the angle of inclination of the gently inclined surface 50 with respect to the plate body 30.

A peak surface 54 that is substantially parallel to the plate body 30 is formed at the second projecting portion 46, and steeply inclined surfaces 56, 58, whose angles of inclination with respect to the plate body 30 are greater than those of the inclined surface 52 and that are inclined in the arrow A direction and the arrow B direction respectively, are formed at the second projecting portion 46 at the arrow A direction side and the arrow B direction side of the peak surface 54.

The third projecting portion 48 is substantially rectangular, and a recess 60 that is circular-arc-shaped is formed at the arrow B side surface on which a boss 82A of a shield base 74 is anchored, in order to anchor the boss 82A that is shaped as a cylindrical tube.

The chin guard 16 is described next. As shown in FIG. 1 and FIG. 2, the chin guard 16 has a chin guard main body 70 that is formed in a substantial U-shape, and proximal end portions 72 that are the left and right both end portions of the chin guard main body 70. Because the proximal end portions 72 are structured so as to have left-right symmetry at the left and the right, only the proximal end portion 72 at the left side is described, and description of the right side is omitted.

As shown in FIG. 3, the shield base 74 that is disposed at the outer side of the supporting plate 26 is mounted to the proximal end portion 72. As shown in FIG. 7 and FIG. 8, the shield base 74 has a mounting portion 76 that is formed in a substantial J-shape as seen in a side view, and a rotation center portion 78 that is substantially shaped as a flat plate and is formed at the inner side of the mounting portion 76.

Plural grooves 80 that are U-shaped in cross-section are formed in the mounting portion 76 along the substantial J-shape as seen in a side view. Due to plural projections that are not illustrated and that are formed at each proximal end portion 72 being inserted in these grooves 80, the shield base 74 is positioned with respect to the chin guard main body 70.

Further, as shown in FIG. 8, bosses 82A~82D for fastening are provided at four places at a predetermined interval at the inner side surface of the mounting portion 76. Hole portions 84A~84D for the insertion of screws therethrough are formed in the bosses 82A~82D, respectively. Due to unillustrated screws being inserted into these hole portions 84A~84D for the insertion of screws therethrough and being fastened to the chin guard main body 70, the shield base 74 is fixed to the chin guard main body 70.

On the other hand, a hole portion 86, into which the boss 32 of the supporting plate 26 is inserted and into which the contact pieces 96A, 96B, 96C of the shalt member 90 that is described later are inserted, is formed in the center of the rotation center portion 78. The inner peripheral surface of the hole portion 86 serving as a supporting hole is a cam surface 88 that is abutted by the contact pieces 96A, 96B, 96C of the shaft member 90. Note that the shape of the hole portion 86 is described later.

The shall member 90 serving as a supporting Shaft is disposed at the outer side (the left side) of this shield base 74.

As shown in FIG. 7 and FIG. 8, the shaft member 90 has a disc portion 92 that is substantially circular as seen in a side view and that is positioned at the outer (left) side, a boss portion 94 that is substantially shaped as a cylindrical tube as seen in a side view and that is formed continuously with the inner side of the disc portion 92 and whose diameter is smaller than that of the disc portion 92, and the three contact pieces 96A, 96B, 96C (hereafter called "contact pieces 96A~96C") that partially project-out toward the radial direction outer side from the outer peripheral surface of the boss portion 94 and that are formed so as to also project-out toward the axial direction inner (right) side from the boss portion 94.

A recess 102 is formed in the central portion of the outer (left) side surface of the disc portion 92. An insert-through hole 100, which extends in the axial direction and whose diameter is smaller than that of the recess 102, is formed in the inner (right) side bottom surface of the recess 102. Note that the disc portion 92 is made to be a shape that is such that it cannot be inserted-through the hole portion 86 of the shield base 74 (is made to be a shape that is larger than the hole portion 86).

The boss portion 94 is, as seen in a side view, substantially shaped as a cylindrical tube whose diameter is smaller than the disc portion 92. A hole portion 104, which is circular and communicates with the insert-through hole 100 and is larger than the insert-through hole 100, is formed in the center of the boss portion 94. The hole portion 104 is a hole portion that is shaped as an ellipse that corresponds to the shape of the boss 32 of the supporting plate 26.

The contact pieces 96A~96C are shaped as solid cylinders that are circular as seen in a side view, and are formed such that portions thereof project-out toward the radial direction outer side from the outer peripheral surface of the boss portion 94. Further, the axial direction lengths of the contact pieces 96A~96C are longer than the axial direction length of the boss portion 94, and the inner side end portions of the contact pieces 96A~96C project-out toward the inner (right) side from the boss portion 94.

Here, due to the boss portion 94 of the shaft member 90 being inserted in the hole portion 86 of the shield base 74, the three contact pieces 96A~96C abut the inner peripheral surface of the hole portion 86, and the portions, which project-out toward the axial direction inner side from the boss portion 94, are inserted in the long holes 36 of the supporting plate 26.

Due thereto, the shaft member 90 is positioned with respect to the supporting plate 26, and, due to a screw being inserted in the insert-through hole 100 of the shaft member 90 and the insert-through hole 34 of the supporting plate 26 and being fastened, the shaft member 90 is mounted to the supporting plate (the helmet main body 14).

Here, the positional relationships between the contact pieces 96A~96C of the shaft member 90 and the hole portion 86 of the shield base 74 are described in detail with reference to FIG. 10 through FIG. 14.

Figure 12A:
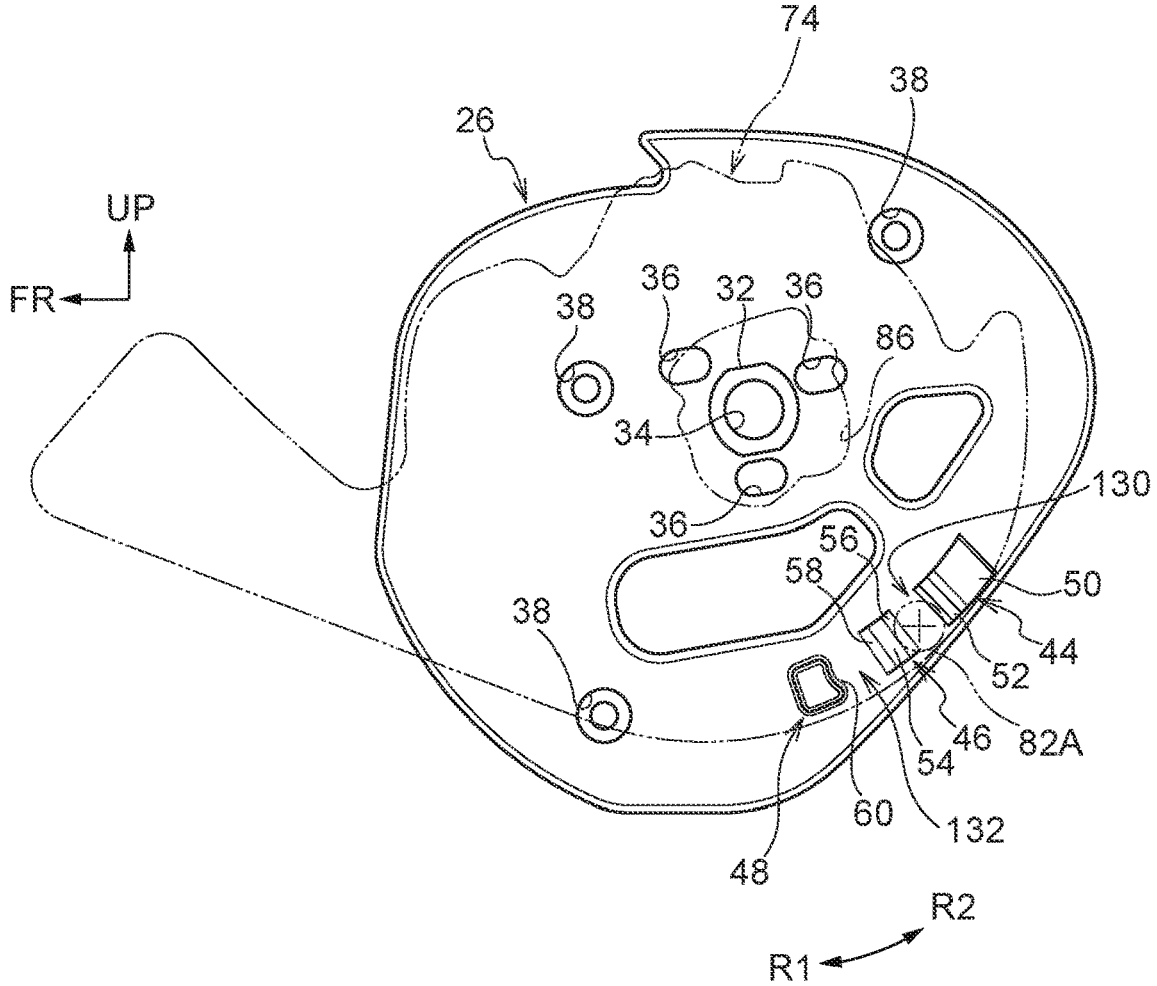
FIG. 12A is a side view showing the positional relationship between the supporting plate and the shield base in the temporarily anchored (temporarily locked) state, relating to the embodiment.

First, the shape of the hole portion 86 is described in detail with reference to FIG. 14. The orientation of the hole portion 86 in FIG. 14 is that at the time when the chin guard 16 is in the fully closed state. Note that, in FIG. 14, the "+" mark indicates the central position of the hole portion 86 (and the same holds for FIG. 10B~FIG. 13B as well).

The hole portion 86 has a first curved surface 110 serving as a decentering surface that is positioned at the front side and is formed in a substantially rectilinear shape in the vertical direction and is inclined toward the rear side at the lower portion, a first inclined surface 112 that is inclined from the lower end of the first curved surface 110 toward the radial direction inner side, a second curved surface 114 that is curved from the rear side end portion of the first inclined surface 112 convexly toward the radial direction outer side such that a portion of the contact piece 96B fits together therewith shallowly, a third curved surface 116 serving as a decentering surface that is greatly curved from the end portion of the second curved surface 114 convexly toward the radial direction outer side, a second inclined surface 118 that is inclined from the end portion of the third curved surface 116 toward the radial direction inner side, a fourth curved surface 120 serving as a decentering surface that is curved from the end portion of the second inclined surface 118 convexly toward the radial direction outer side, a fifth curved surface 122 that is curved from the end portion of the fourth curved surface 120 convexly toward the radial direction outer side such that the contact piece 96C fits together therewith, and a third inclined surface 124 that is inclined from the end portion of the fifth curved surface 122 toward the radial direction outer side while heading toward the first curved surface 110. Note that the first inclined surface 112 corresponds to the anchor surface, and the fifth curved surface 122 corresponds to the concave portion.

When the shaft member 90 is inserted in the hole portion 86, as shown in FIG. 10B through FIG. 12B, even if the chin guard 16 (the shield base 74) rotates, the contact pieces 96A~96C respectively are maintained in states of abutting the inner peripheral surface of the hole portion 86. Concretely, when the chin guard 16 rotates, the contact piece 96A moves relative to the hole portion 86 while continuing to abut the first curved surface 110. Further, the contact piece 96B moves relative to the hole portion 86 while continuing to abut the second curved surface 114 and the third curved surface 116. Moreover, the contact piece 96C moves relative to the hole portion 86 while continuing to abut the fourth curved surface 120 and the fifth curved surface 122.

(Operation)

Operation of the helmet 10 relating to the present embodiment is described. A case in which the chin guard 16 is rotated from the fully closed state to the fully open state is described.

Figure 10A:
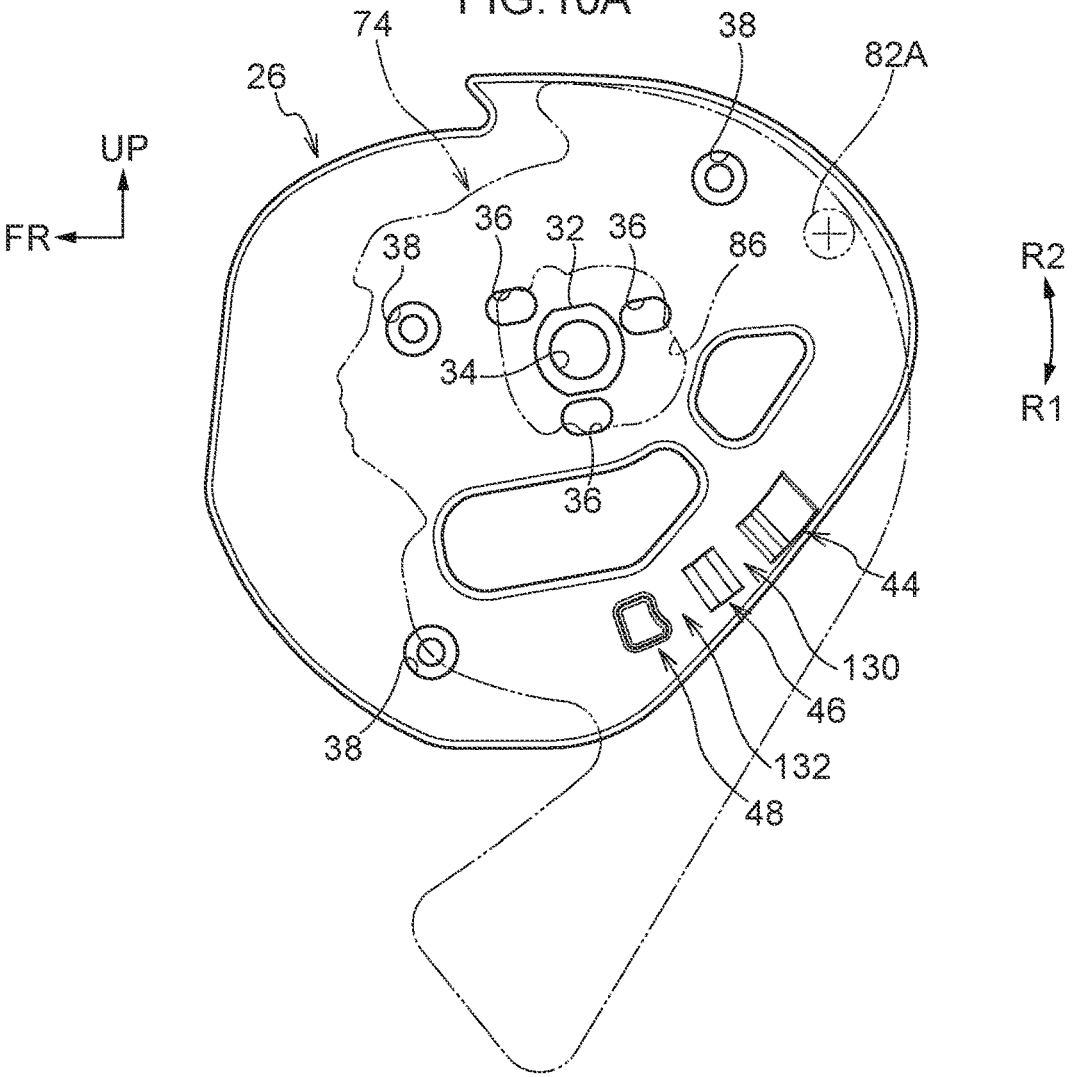
FIG. 10A is a side view showing the positional relationship between the supporting plate and the shield base in the fully closed state, relating to the embodiment.
Figure 10B:
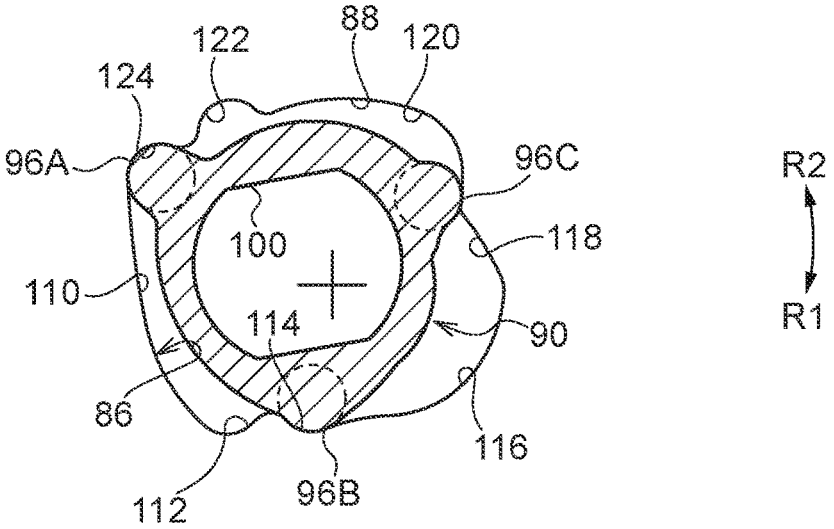
FIG. 10B is a partial sectional view showing the positional relationship between a hole portion of the shield base in the fully closed state and contact pieces of a shaft member, relating to the embodiment.

First, a case in which the chin guard 16 is in the fully closed state (the position of FIG. 3) is described. At this time, the shield base 74 is at the position shown in FIG. 10A with respect to the supporting plate 26, and the boss 82A that is formed at an inner side surface 74A of the shield base 74 is at a position of being far apart from the first projecting portion 44, the second projecting portion 46 and the third projecting portion 48 of the supporting plate 26. Namely, the shield base 74 rotates freely with respect to the supporting plate 26, without the bosses 82A~82D, including the boss 82A, interfering with the first projecting portion 44~ the third projecting portion 48. Further, at this time, as shown in FIG. 10B, the shaft member 90 that is inserted in the hole portion 86 is in a state in which the contact piece 96A abuts the third inclined surface 124 that is at the upper end portion of the first curved surface 110. Further, the contact piece 96B is in a state of being fit together with the curved surface 114. However, because the curved surface 114 is made to fit together with only a small portion of the contact piece 96B that is circular as seen in a side view, if a rotational moment is applied to the shield base 74, rotational movement of the shield base 74 is not impeded. Moreover, the contact piece 96C is positioned at the second inclined surface 118 side end portion of the fourth curved surface 120. Namely, due to the contact pieces 96A~96C being positioned at the above-described positions, the shield base 74 (the chin guard 16) is unable to rotate in the arrow R2 direction, and can rotate in the arrow R1 direction.

Figure 4:
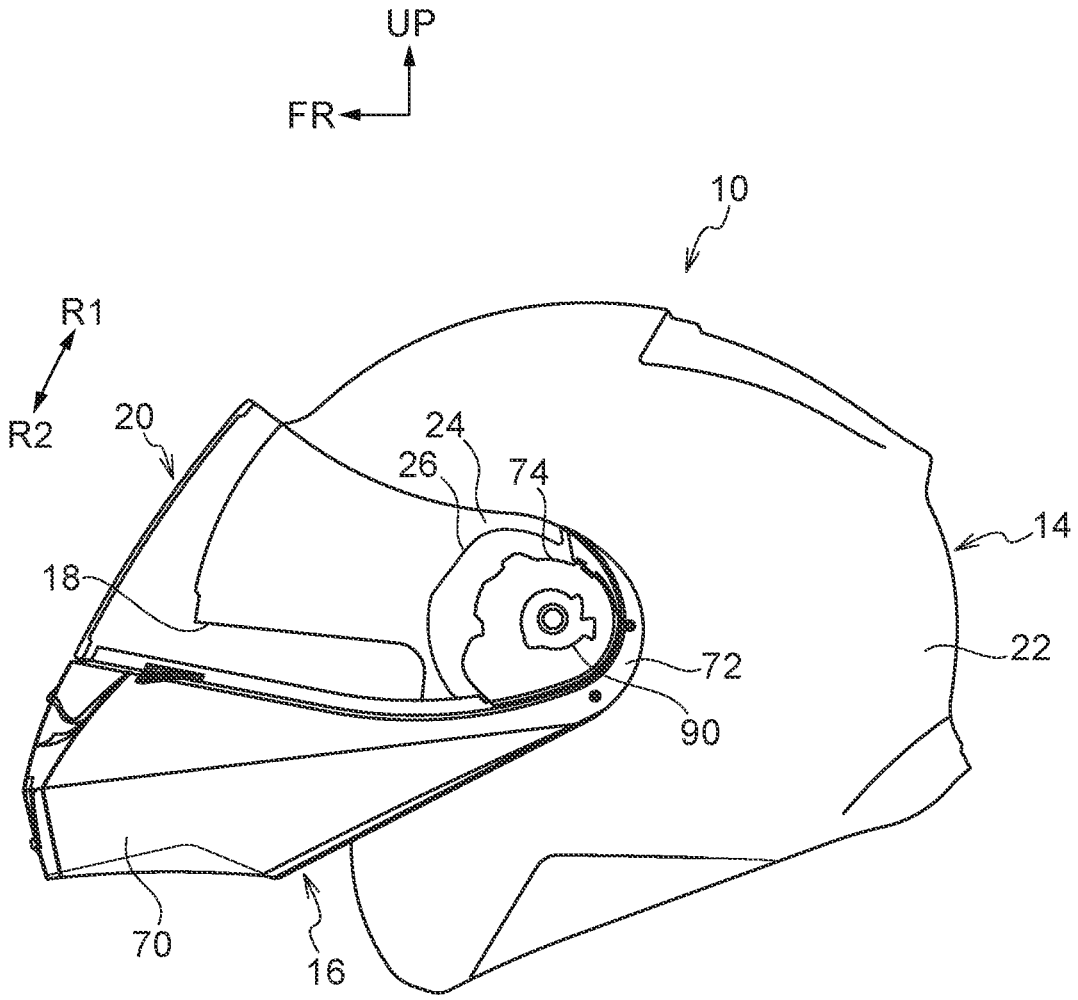
FIG. 4 is a partially omitted side view showing a state in which the chin guard is decentered, of the helmet relating to the embodiment.
Figure 5:
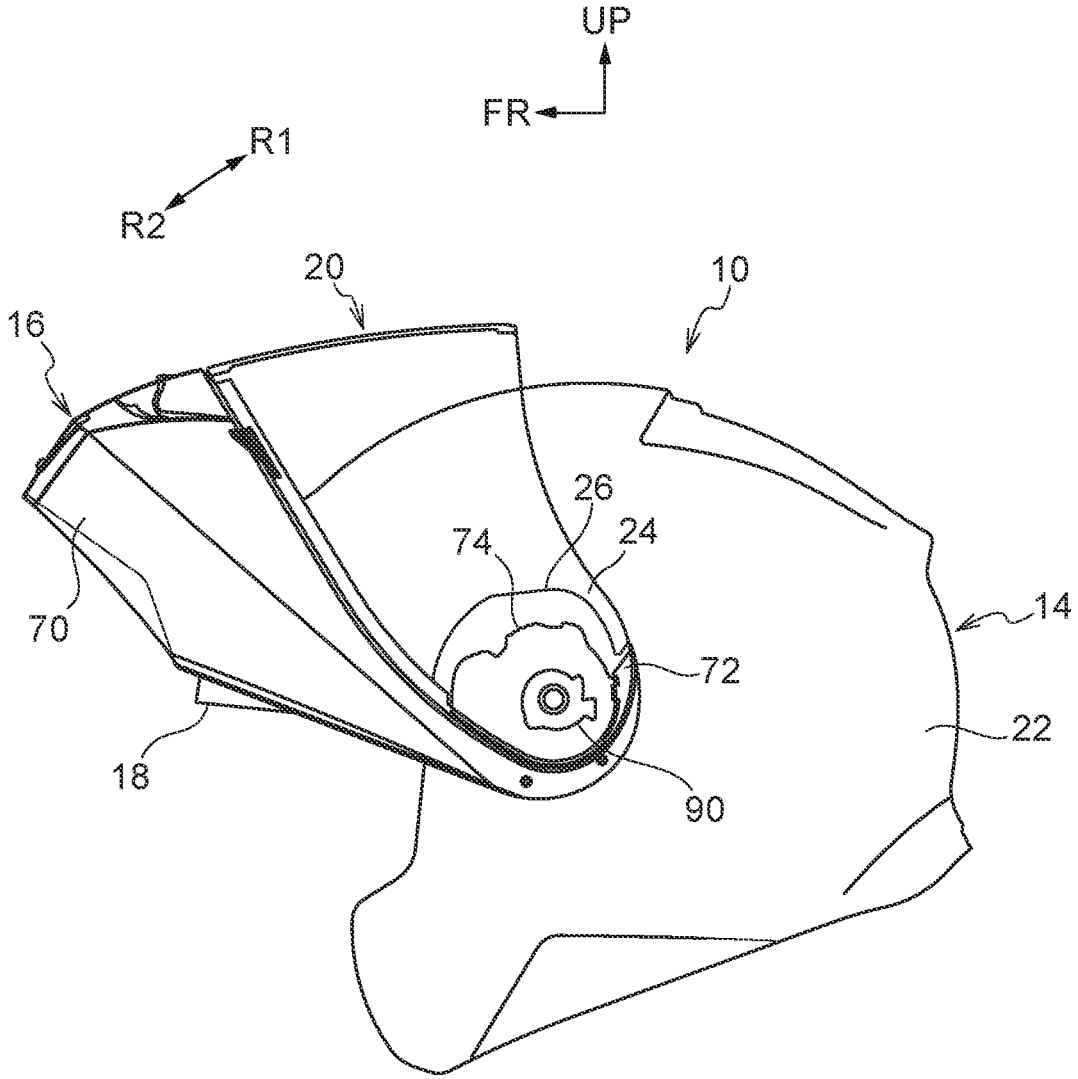
FIG. 5 is a partially omitted side view showing a state in which the chin guard is temporarily anchored (temporarily locked), of the helmet relating to the embodiment.
Figure 11A:
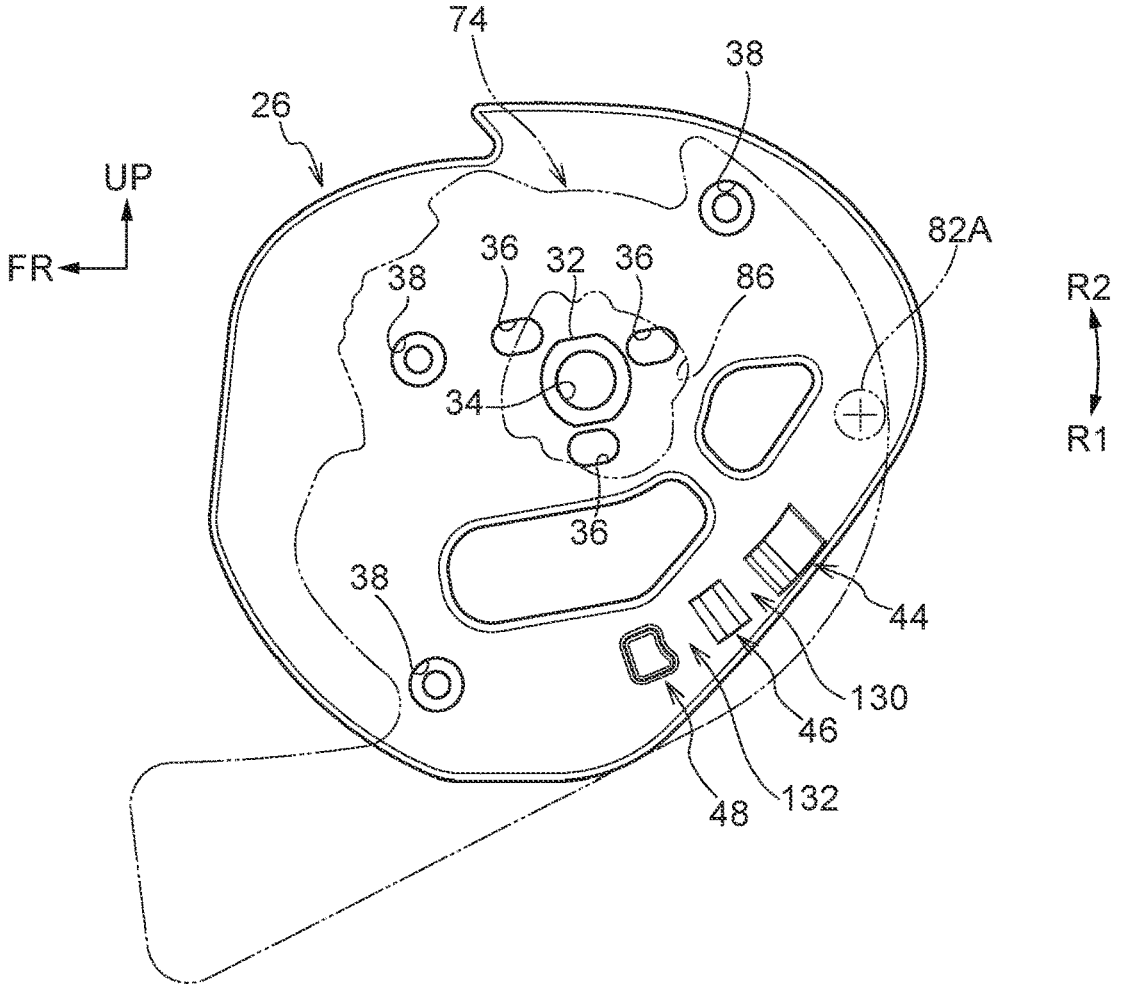
FIG. 11A is a side view showing the positional relationship between the supporting plate and the shield base in the decentered state, relating to the embodiment.
Figure 11B:
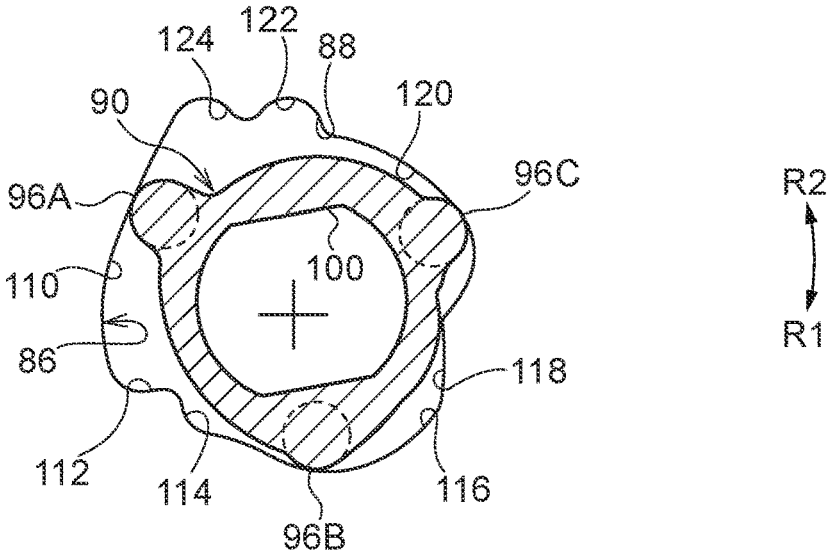
FIG. 11B is a partial sectional view showing the relationship between the hole portion of the shield base in the decentered state and the contact pieces of the shaft member, relating to the embodiment.

When the chin guard 16 starts to be rotated in the fully open direction, as shown in FIG. 11B, the contact piece 96A moves relatively on the first curved surface 110 from the third inclined surface 124 side toward the first inclined surface 112 side. Similarly, the contact piece 96B comes-out from the second curved surface 114, and relatively moves on the third curved surface 116 toward the second inclined surface 118 side. Moreover, the contact piece 96C moves relatively on the fourth curved surface 120 toward the fifth curved surface 122 side. Due thereto, the shield base 74 moves toward the front side while rotating in the arrow R1 direction. Namely, as shown in FIG. 4, the chin guard 16 and the shield base 74 rotate (are decentered) upward (in the arrow R1 direction) while moving forward.

At this time, the shield base 74 is at the position shown in FIG. 11A with respect to the supporting plate 26, and the boss 82A of the shield base 74 is at a position of being apart from the first projecting portion 44, the second projecting portion 46 and the third projecting portion 48 of the supporting plate 26. Namely, rotation of the shield base 74 is not interfered with by the supporting plate 26.

Due thereto, at the time when the chin guard 16 is raised (rotated), the shield 20 and the chin guard 16 are prevented from interfering with the upper edge portion and the like of the window portion 18 of the helmet main body 14.

Figure 12B:
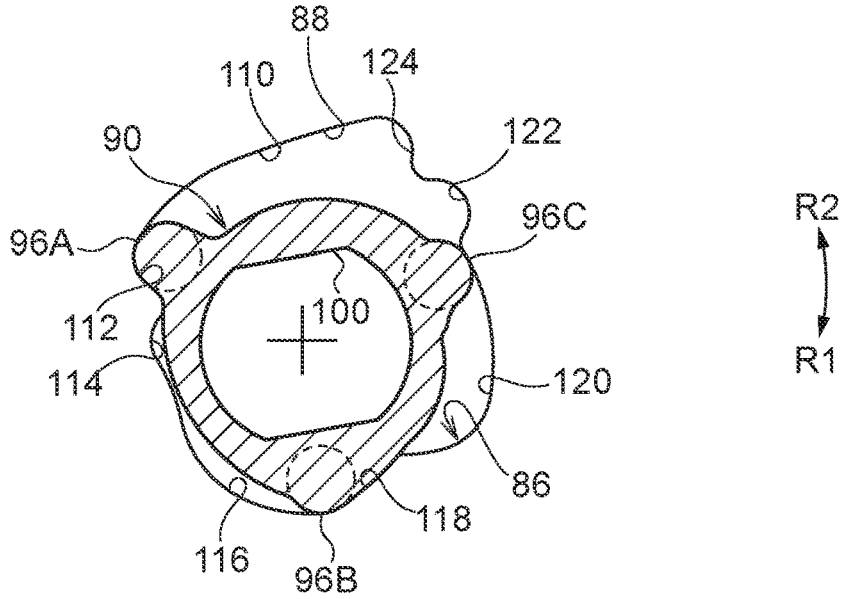
FIG. 12B is a partial sectional view showing the positional relationship between the hole portion of the shield base in the temporarily anchored (temporarily locked) state and the contact pieces of the shaft member, relating to the embodiment.
Figure 13A:
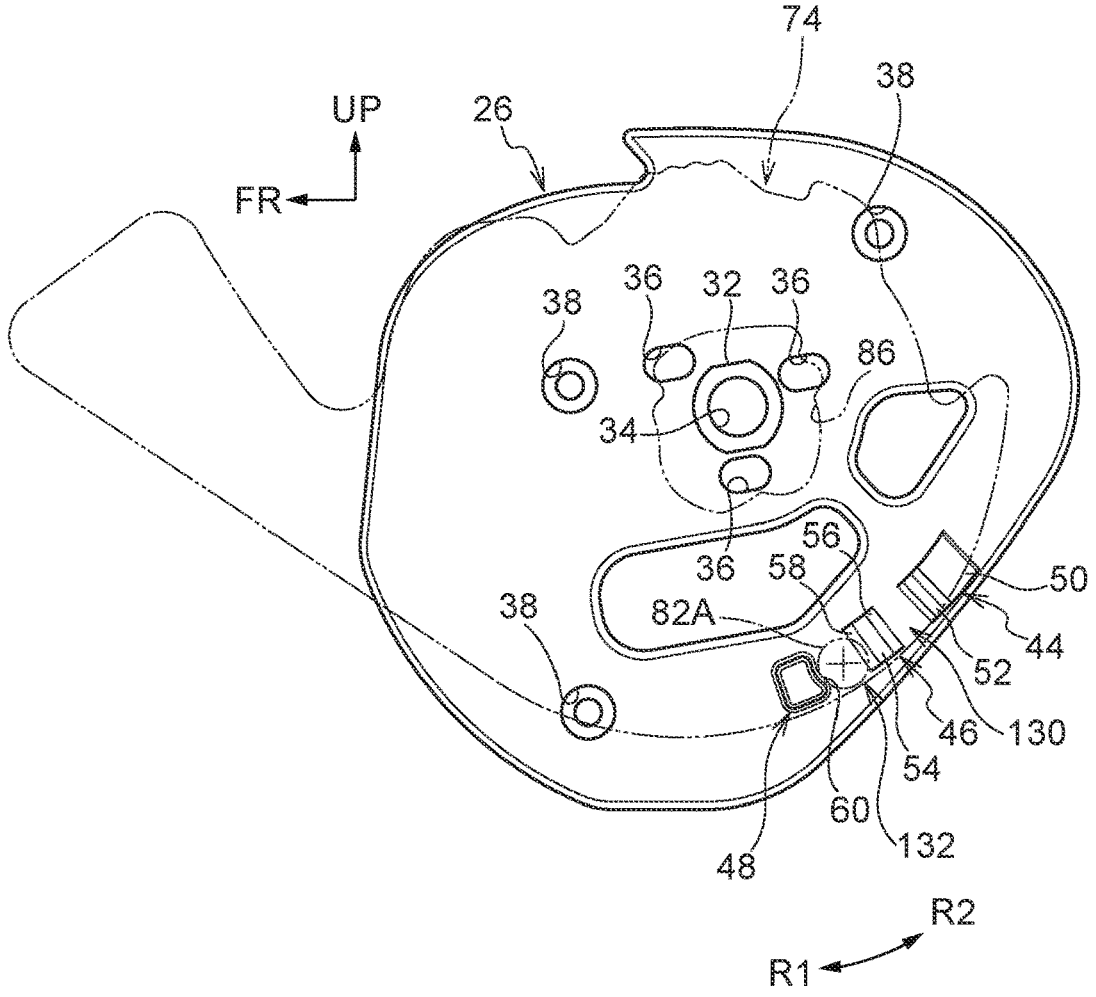
FIG. 13A is a side view showing the positional relationship between the supporting plate and the shield base in the fully open (actually locked) state, relating to the embodiment.

Moreover, due to the chin guard 16 (the shield base 74) being rotated in the arrow R1 direction, as shown in FIG. 12B, the contact piece 96A abuts the first inclined surface 112 that is formed at an incline toward the radial direction inner side, and the contact piece 96B abuts the second inclined surface 118. Due thereto, rotation of the shield base 74 is temporarily stopped. Further, relative rotation is temporarily stopped. Due thereto, the relative movement of the contact piece 96C also is temporarily stopped at the fifth curved surface 122 side end portion of the fourth curved surface 120.

Further, due to rotation of the shield base 74, the boss 82A of the shield base 74 rides-up the gently inclined surface 50 of the first projecting portion 44, and moves down along the inclined surface 52, and, due thereto, is anchored between the first projecting portion 44 and the second projecting portion 46 (refer to FIG. 12A). Here, because the supporting plate 26 is a thin plate body that is made of resin, due to the boss 82A moving relatively on the first projecting portion 44, the boss 82A pushes the supporting plate 26 toward the inner side, but the pushing action is absorbed due to the supporting plate 26 that is flexible deforming.

In this way, the relative rotation of the contact piece 96A with respect to the cam surface 88 is stopped at the first inclined surface 112, and the boss 82A is anchored between the first projecting portion 44 and the second projecting portion 46 (concretely, at the second projecting portion 46). Due thereto, rotation of the shield base 74 in the arrow R1 direction is temporarily stopped.

Further, due to the boss 82A being anchored between the first projecting portion 44 and the second projecting portion 46 (concretely, at the first projecting portion 44), rotation of the shield base 74 in the arrow R2 direction is prevented. Namely, the chin guard 16 is temporarily anchored at the position shown in FIG. 5 (temporary locking is carried out). Accordingly, due to the wearer raising and rotating the chin guard 16 and the shield 20 by a given force, the chin guard 16 can easily be temporarily anchored and the opening portion 12 can be opened, and the chin guard 16 and the shield 20 falling-down due to the self-weights thereof can be prevented.

Figure 13B:
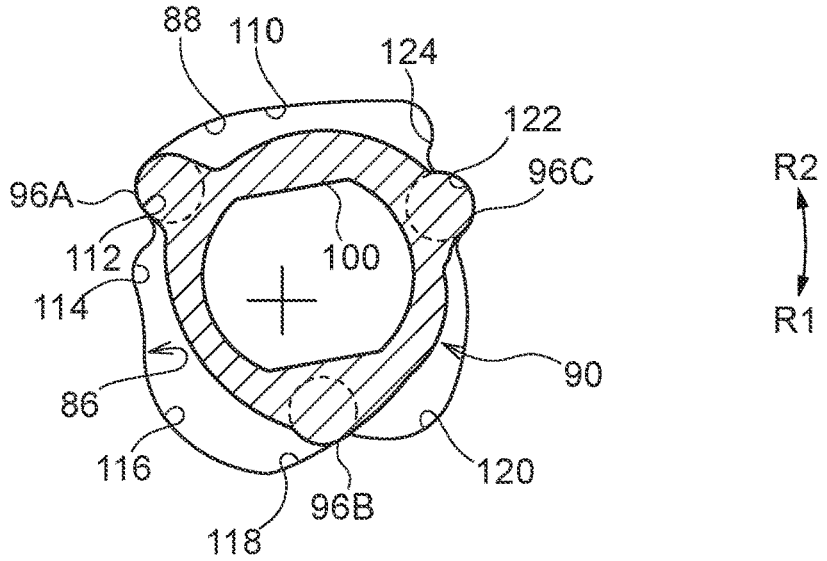
FIG. 13B is a partial sectional view showing the positional relationship between the hole portion of the shield base in the fully open (actually locked) state and the contact pieces of the shaft member, relating to the embodiment.
Figure 14:
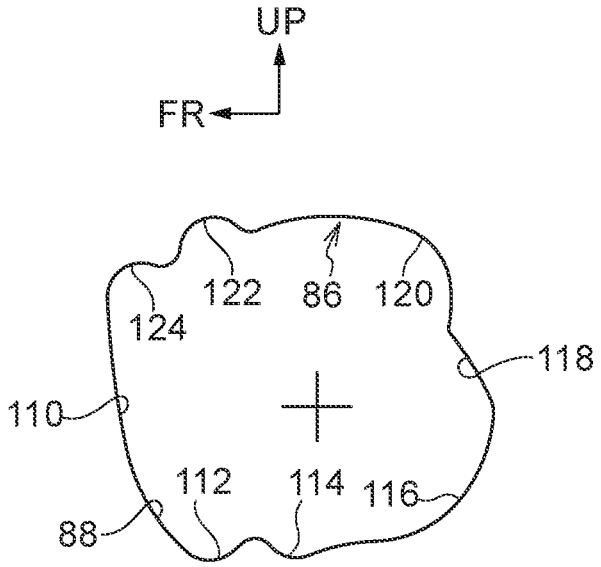
FIG. 14 is a side view showing the shape of the hole portion of the shield base relating to the embodiment.

On the other hand, in a case in which the wearer is traveling with the chin guard 16 and the shield 20 remaining open, due to the wearer applying more force and rotating the chin guard 16 in the arrow R1 direction, as shown in FIG. 13B, the contact piece 96B moves relatively on the second inclined surface 118 toward the radial direction inner side, and the contact piece 96C fits together with the inner portion of the fifth curved surface 122 from the fourth curved surface 120 end portion. Note that the contact piece 96A remains anchored by the first inclined surface 112 and therefore is not displaced. In this way, because the contact piece 96A is anchored by the first inclined surface 112, and the contact piece 96C is in a state of being fit together with the fifth curved surface 122, rotation of the shield base 74, i.e., the chin guard 16, is stopped and is locked (actually locked).

Further, as shown in FIG. 13A, the boss 82A of the shield base 74 also rides-up and over the steeply inclined surface 56 of the second projecting portion 46 of the supporting plate 26, and fits together between the second projecting portion 46 and the third projecting portion 48. At this time, due to a portion of the outer peripheral surface of the boss 82A fitting together with the recess 60 of the third projecting portion 48, the boss 82A is stably fit together between the second projecting portion 46 and the third projecting portion 48.

Figure 6:
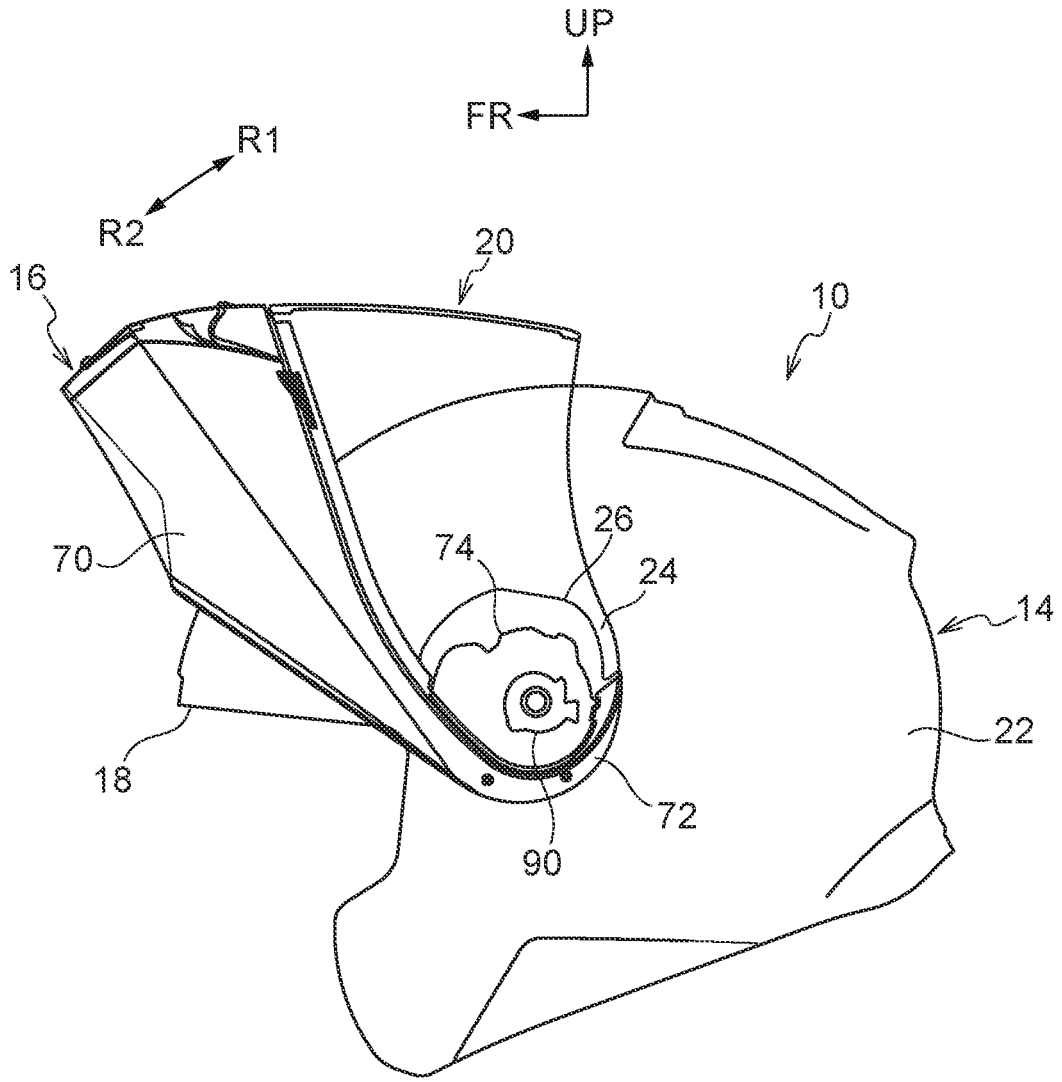
FIG. 6 is a partially omitted side view showing a state in which the chin guard is fully open (actually locked), of the helmet relating to the embodiment.

In this way, due to the wearer applying more force from the temporarily locked state of the chin guard 16 and rotating the chin guard 16 in the arrow R1 direction, as shown in FIG. 6, the chin guard 16 can be actually locked at the helmet main body 14. Namely, due to the contact piece 96C of the shaft member 90 being made to fit together with the fifth curved surface 122, and because the chin guard 16 is locked by the boss 82A of the shield base 74 and the second projecting portion 46 and the third projecting portion 48 of the supporting plate 26, the chin guard 16 and the shield 20 falling-down toward the fully closed position during traveling can be prevented reliably.

In this way, at the helmet 10 of the present embodiment, the fifth curved surface 122 for locking (actually locking) the chin guard 16 is provided at the cam surface 88 of the hole portion 86 of the shield base 74 that rotates together with the chin guard 16. Therefore, due to the contact piece 96C fitting together with the fifth curved surface 122, the locking performance of the chin guard 16 can be improved.

In particular, this hole portion 86 is provided as a cam surface that is provided in order to decenter the chin guard 16 and the shield 20 toward the front side at the time of fully opening the chin guard 16 and the shield 20. The locking performance is improved by devising the shape of this hole portion 86 and without increasing the number of parts.

Further, by providing the first projecting portion 44, the second projecting portion 46 and the third projecting portion 48 at the supporting plate 26, temporary locking is made possible due to the boss 82A of the shield base 74 being inserted between the first projecting portion 44 and the second projecting portion 46 at the time of temporary locking, and, by adding the third projecting portion 48 adjacent to the second projecting portion 46, actual locking is made possible due to the boss 82A being inserted between the second projecting portion 46 and the third projecting portion 48.

Namely, by providing the third projecting portion 48 so as to be lined-up with the first projecting portion 44 and the second projecting portion 46 of the supporting plate 26 that are provided for temporary locking, not only temporary locking, but also locking can be carried out also between the supporting plate 26 and the shield base 74 at the time of actual locking as well. Namely, the locking performance at the time of actual locking can be improved more without increasing the number of parts.

Further, because temporary locking is possible before actual locking, there is the advantage that, in a case of temporarily opening the opening portion 12 such as the wearer eating and drinking or smoking or the like, usage in the temporarily locked state suffices.

Note that the shape of the cam surface 88 of the hole portion 86 of the shield base 74 of the present embodiment is not limited to that of the present embodiment. Namely, the concrete shape thereof is not particularly limited provided that, at the cam surface 88, there are formed a surface that decenters the chin guard 16, and a surface that imparts resistance to the relative rotational motion between the shield base 74 and the shaft member 90 (the contact pieces 96A~96C) before the chin guard 16 is fully opened, and a surface (the concave portion) that locks the chin guard 16 at the helmet main body 14 due to at least one of the contact pieces 96A~96C being fit together therewith when the chin guard 16 is fully opened.

Moreover, the surface that decenters the chin guard 16 does not have to be at the cam surface 88. Namely, there may be a structure in which the decentering of the chin guard 16 is achieved by another mechanism.

Note that, in the description of the present embodiment, description is given by using mainly a helmet for riding a motorcycle as an example. However, the helmet of the present embodiment can be employed provided that there is a helmet in which the chin guard 16 can be opened and closed with respect to the helmet main body 14 as described above. Namely, the present disclosure can be employed at helmets for bicycles, sports, snowmobiling, water skiing, and the like.

Although an embodiment of the present disclosure has been described above, the present disclosure is not limited to the above, and can of course be implemented by being modified in various ways other than the above within a scope that does not depart from the gist thereof.

The disclosure of Japanese Patent Application No. 2017-101150 is, in its entirety, incorporated by reference into the present specification.

All publications, patent applications, and technical standards mentioned in the present specification are incorporated by reference into the present specification to the same extent as if such individual publication, patent application, or technical standard was specifically and individually indicated to be incorporated by reference.

The invention claimed is:

1. A helmet comprising:

supporting shafts fixed to outer side surfaces of a helmet main body, the supporting shafts having outer peripheral surfaces at which a plurality of contact pieces are formed; and a chin guard having proximal end portions forming supporting holes into which the supporting shafts are inserted, the chin guard being mounted to rotate around the supporting shafts that are inserted into the supporting holes, between a fully closed position at which the chin guard protects a jaw of a helmet wearer and a fully open position at which the chin guard expands a field of view of the helmet wearer, and at which cam surfaces, having positions of contact with the contact pieces that change accompanying rotation, are formed at inner peripheral surfaces of the supporting holes, wherein each cam surface has an anchor surface that, in a case in which the chin guard is rotated to a position immediately before the fully open position, by being abutted by at least one of the contact pieces accompanying rotation, imparts resistance in a direction opposite to a rotating direction of the chin guard, and a concave portion into which, in a case in which the chin guard is rotated past the immediately before the fully open position to the fully open position, at least one of the contact pieces is fit and that fixes the chin guard at the fully open position, and wherein, when the chin guard rotates to the fully open position, the chin guard is fixed due to at least a first one of the contact pieces abutting the anchor surface of the cam surface, at least a second one of the contact pieces being fit in the concave portion.

2. The helmet of claim 1, wherein each cam surface further has a decentering surface that, in a case in which the chin guard is rotated from the fully closed position to the fully open position, by being abutted by at least one of the contact pieces accompanying rotation, pushes the chin guard out in a forward direction.

3. The helmet of claim 2, wherein each supporting shaft has a supporting plate that is mounted to an outer side surface of the helmet main body, and a shaft member that is mounted to the supporting plate with a proximal end portion of the chin guard between the shaft member and the supporting plate, and has an outer peripheral surface forming the contact pieces that abut the cam surface that is formed at the supporting hole of the proximal end portion.

4. The helmet of claim 1, wherein each supporting shaft has a supporting plate that is mounted to an outer side surface of the helmet main body, and a shaft member that is mounted to the supporting plate with a proximal end portion of the chin guard between the shaft member and the supporting plate, and has an outer peripheral surface forming the contact pieces that abut the cam surface that is formed at the supporting hole of the proximal end portion.

5. The helmet of claim 4, wherein a projecting portion that projects out toward a supporting plate side is formed at each proximal end portion, and a temporarily anchoring concave portion, on which the projecting portion is anchored when the chin guard arrives at the position immediately before the fully open position, is formed at a surface that is at a proximal end portion side of the supporting plate.

6. The helmet of claim 5, wherein a projecting portion that projects out toward a supporting plate side is formed at each proximal end portion, and an actually anchoring concave portion, with which the projecting portion is fit together when the chin guard arrives at the fully open position, is formed at a surface that is at a proximal end portion side of the supporting plate.

7. The helmet of claim 4, wherein a projecting portion that projects out toward a supporting plate side is formed at each proximal end portion, and an actually anchoring concave portion, with which the projecting portion is fit together when the chin guard arrives at the fully open position, is formed at a surface that is at a proximal end portion side of the supporting plate.

8. A helmet comprising:

a shaft mechanism having a supporting plate and a supporting shaft, the shaft mechanism being fixed to an outer side surface of a helmet main body, the supporting shaft having a plurality of contact pieces formed on an outer peripheral surface; and a chin guard having a proximal end connected to the supporting shaft such that the chin guard rotates about the supporting shafts at a closed position, a temporarily open position, and a fully open position, the chin guard having a cam surface forming a closed loop surrounding the contact pieces, wherein the chin guard is configured to:

rotate about a rotation axis between the closed position and the temporarily open position, and rotate about a first contact piece of the plurality of contact pieces between the temporarily open position and the fully open position, the rotation axis does not overlap with the first contact piece.

9. The helmet of claim 8, wherein the cam surface includes:

an anchor surface configured to engage with the first contact piece when the chin guard is at the temporarily open position and at the fully open position, and a concave surface configured to engage with a second contact piece of the plurality of contact pieces when the chin guard is at the fully open position.

10. The helmet of claim 9, wherein the cam surface further includes:

an inclined surface configured to engage with the first contact piece when the chin guard is at the closed position.

11. The helmet of claim 9, wherein the chin guard further includes a boss, wherein the supporting plate is located between the proximal end of the chin guard and the helmet main body, the supporting plate having a plurality of projecting portions projecting toward the proximal end of the chin guard and forming a first anchoring concave portion and a second anchoring concave portion therebetween, wherein the first anchoring concave portion is configured to accommodate the boss when the chin guard is at the temporarily open position, and the second anchoring concave portion is configured to accommodate the boss when the chin guard is at the fully open position.

* * * * *